US010065719B1

(12) United States Patent
Hoover

(10) Patent No.: US 10,065,719 B1
(45) Date of Patent: Sep. 4, 2018

(54) VERTICAL RECOVERY FOR AN UNMANNED UNDERWATER VEHICLE

(71) Applicant: The Boeing Company, Chicago, IL (US)

(72) Inventor: Randall L. Hoover, Yorba Linda, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/634,106

(22) Filed: Jun. 27, 2017

(51) Int. Cl.

| | |
|---|---|
| ***B63G 8/14*** | (2006.01) |
| ***B63G 8/22*** | (2006.01) |
| ***B63G 8/00*** | (2006.01) |
| ***B63G 8/39*** | (2006.01) |
| ***B63G 8/26*** | (2006.01) |

(52) U.S. Cl.
CPC ..... *B63G 8/22* (2013.01); *B63G 8/001* (2013.01); *B63G 8/26* (2013.01); *B63G 8/39* (2013.01); *B63B 2207/02* (2013.01); *B63G 2008/004* (2013.01)

(58) Field of Classification Search
CPC . B63G 8/001; B63G 8/22; B63G 8/26; B63G 8/08
See application file for complete search history.

(56) References Cited

U.S. PATENT DOCUMENTS

| | | | | |
|---|---|---|---|---|
| 3,921,943 | A * | 11/1975 | Munro | B64D 1/22 114/240 R |
| 3,943,875 | A * | 3/1976 | Sanders | B63B 21/56 114/244 |
| 6,164,179 | A | 12/2000 | Buffman | |
| 6,502,527 | B1 | 1/2003 | Danielson | |
| 6,600,695 | B1 | 7/2003 | Nugent et al. | |
| 7,798,086 | B2 | 9/2010 | Ruggaber | |
| 8,020,505 | B1 * | 9/2011 | Galway | B63B 21/58 114/249 |
| 8,336,479 | B2 * | 12/2012 | Vosburgh | B63G 8/00 114/322 |

* cited by examiner

*Primary Examiner* — Stephen P Avila
(74) *Attorney, Agent, or Firm* — McDonnell Boehnen Hulbert & Berghoff LLP

(57) ABSTRACT

A recovery system for an unmanned underwater vehicle (UUV) includes an elongate recovery container sized to contain the UUV, and a recovery cable coupled to the elongate recovery container, where the recovery cable is retractable into the elongate recovery container to capture and stow the UUV within the elongate recovery container. The system also includes the UUV, which includes a forward looking sonar system configured to locate the recovery cable and a capture clip coupled to a nose portion of the UUV, where the capture clip is configured to be releasably secured to the recovery cable. The UUV further includes at least one ballast tank capable of trimming the UUV to a vertical orientation.

20 Claims, 9 Drawing Sheets

VERTICAL RECOVERY FOR AN UNMANNED UNDERWATER VEHICLE

FIELD

The present disclosure generally relates to a recovery system for an unmanned underwater vehicle.

BACKGROUND

After an unmanned underwater vehicle (UUV) has completed its underwater operations, it may be desirable to recover and stow the UUV. UUVs operate in a horizontal orientation, and they are typically stowed as such. However, if stowage of the UUV is desired in a vertical orientation, it may require a complex mechanism to capture the UUV in its operational, horizontal orientation, and then rotate it to a vertical orientation. This re-orientation system may occupy volume within the stowage space, and by extension, may reduce the available volume of the UUV.

What is needed is an improved way to recover and stow a UUV in a vertical orientation.

SUMMARY

In one example, a recovery system for an unmanned underwater vehicle (UUV) is described including an elongate recovery container sized to contain the UUV. The system also includes a recovery cable coupled to the elongate recovery container, where the recovery cable is retractable into the elongate recovery container to capture and stow the UUV within the elongate recovery container. The system further includes the UUV, including a forward looking sonar system configured to locate the recovery cable and a capture clip coupled to a nose portion of the UUV, where the capture clip is configured to be releasably secured to the recovery cable. The UUV also includes at least one ballast tank capable of trimming the UUV to a vertical orientation.

In another example, a method for recovery of a UUV is described. The method includes locating, via a forward looking sonar system of the UUV, a recovery cable that extends underwater in a vertical orientation, where the recovery cable is coupled to an elongate recovery container that is positioned underwater in a vertical orientation. The method further includes guiding the UUV toward the recovery cable, releasably securing the UUV to the recovery cable via a capture clip coupled to a nose portion of the UUV, and adjusting at least one ballast tank to trim the UUV to a vertical orientation. The method also includes causing the elongate recovery container to retract the recovery cable.

In another example, a non-transitory computer readable medium is described. The non-transitory computer readable medium has instructions stored thereon, that when executed by a computing device, cause the computing device to perform functions including locating, via a forward looking sonar system of a UUV, a recovery cable that extends underwater in a vertical orientation, where the recovery cable is coupled to an elongate recovery container that is positioned underwater in a vertical orientation. The functions also include guiding the UUV toward the recovery cable, releasably securing the UUV to the recovery cable via a capture clip coupled to a nose portion of the UUV, and adjusting at least one ballast tank to trim the UUV to a vertical orientation. The functions also include causing the elongate recovery container to retract the recovery cable.

The features, functions, and advantages that have been discussed can be achieved independently in various embodiments or may be combined in yet other embodiments, further details of which can be seen with reference to the following description and drawings.

BRIEF DESCRIPTION OF THE FIGURES

The novel features believed characteristic of the illustrative embodiments are set forth in the appended claims. The illustrative embodiments, however, as well as a preferred mode of use, further objectives and descriptions thereof, will best be understood by reference to the following detailed description of an illustrative embodiment of the present disclosure when read in conjunction with the accompanying Figures.

DETAILED DESCRIPTION

Disclosed embodiments will now be described more fully with reference to the accompanying Figures, in which some, but not all of the disclosed embodiments are shown. Indeed, several different embodiments may be described and should not be construed as limited to the embodiments set forth herein. Rather, these embodiments are described so that this disclosure will be thorough and complete and will fully convey the scope of the disclosure to those skilled in the art.

Examples discussed herein include a recovery system for an unmanned underwater vehicle, methods of operating the recovery system and a computer device to implement such operation. For example, the recovery system may include a vertically oriented recovery cable coupled to an elongate recovery container. The UUV may releasably secure itself to the recovery cable via a capture clip, and then adjust one or more ballast tanks such that it is orientated vertically. The UUV may then be retracted into the elongate recovery container via the recovery cable.

By the term "about" or "substantial" and "substantially" or "approximately," with reference to amounts or measurement values, it is meant that the recited characteristic, parameter, or value need not be achieved exactly. Rather, deviations or variations, including, for example, tolerances, measurement error, measurement accuracy limitations, and other factors known to those skilled in the art, may occur in amounts that do not preclude the effect that the characteristic was intended to provide.

Figure 1:
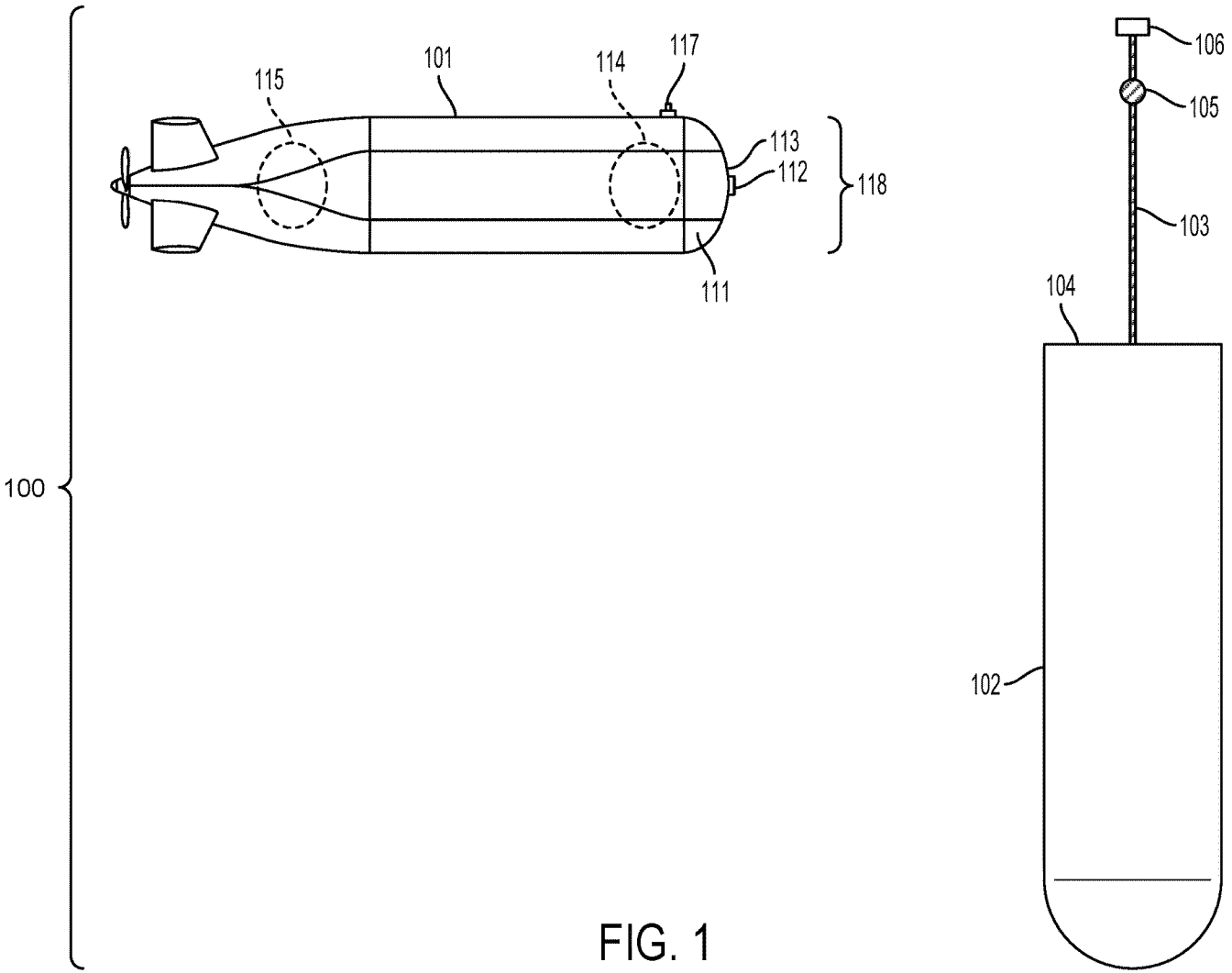
FIG. 1 illustrates a side view of recovery system for an unmanned underwater vehicle (UUV), according to an example implementation.

Referring now to FIG. 1, a recovery system 100 for a UUV is shown. The recovery system 100 includes the UUV 101, and an elongate recovery container 102 sized to contain the UUV 101. For example, as shown in FIG. 1, the elongate recovery container 102 may be vertically oriented, and the UUV 101 may fit inside it after a capture operation is completed. A recovery cable 103 is coupled to the elongate recovery container 102, and is retractable into the elongate recovery container 102 to capture and stow the UUV 101 within the elongate recovery container 102.

The UUV 101 may include a forward looking sonar ("FLS") system 111 that is configured to locate the recovery cable 103. For instance, the FLS system 111 may be tuned to detect and identify a vertical anomaly in the water that may be caused by the recovery cable 103. The UUV 101 may locate the recovery cable 103 in other ways as well. For example, a portion of the recovery cable 103, or the elongate recovery container 102, may emit an acoustic or other type of signal that may be detected by the UUV 101. Other possibilities also exist.

The UUV further includes a capture clip 112 coupled to a nose portion 113 of the UUV 101. The capture clip 112, discussed in more detail below, may be releasably secured to the recovery cable 103. For instance, after the UUV 101 has located the recovery cable 103 using the FLS system 111, it may navigate toward the recovery cable 103 until the nose portion 113 makes contact with the recovery cable 103, which may cause the capture clip 112 to become releasably secured to the recovery cable 103.

The UUV 101 may also include at least one ballast tank 114 capable of trimming the UUV 101 to a vertical orientation. As shown in dashed lines in FIG. 1, the at least one ballast tank may include a forward ballast tank 114 fluidly coupled to aft ballast tank 115. The ballast tanks may be filled with water to maintain and adjust the UUV's buoyancy and trim. For example, after the capture clip 112 is releasably secured to the recovery cable 103, the UUV 101 may flood the forward ballast tank 114 with water from the aft ballast tank 115. This may cause the aft ballast tank 115 of the UUV 101 to become more buoyant than the forward ballast tank 114, causing the UUV 101 to go "nose down" into a vertical orientation. Accordingly, the UUV 101, and forward ballast tank 114 and aft ballast tank 115, are configured to adjust the fluid level in at least one ballast tank to trim the UUV 101 such that the UUV is vertically oriented. The UUV 101 may then be drawn, via the recovery cable 103, downward into the elongate recovery container 102. The recovery container 102 is also vertically oriented, and is configured to retract the recovery cable 103 to capture and stow the vertically oriented UUV 101 within the recovery container 102.

The UUV 101 may include a convex forward face 118, as can be seen in FIG. 1. Other shapes and configurations are also possible, provided that the elongate recovery container 102 can be correspondingly sized to contain the UUV 101. The UUV of FIG. 1 also includes an acoustic communications array 117, which may be used to send and/or receive acoustic communications. In some implementations, the UUV 101 may communicate with the elongate recovery container 102 to initiate one or more of the operations discussed herein, examples of which are provided below.

The elongate recovery container 102 may include a first end 104, shown as its top end in FIG. 1, that is openable to pay out the recovery cable 103. The recovery cable 103 is then retractable into the elongate recovery container 102 via the first end 104. For instance, in some implementations, the recovery cable 103 may include a buoyant portion 106 that may draw the recovery cable 103 upward out of the elongate recovery container once opened. The recovery cable 103 may also include a stop 105, which may be used to secure the UUV 101 to the recovery cable 103, as further discussed below. In some cases, the buoyant portion 106 and the stop 105 may be integrated together, such that they are a single component on the recovery cable 103. Other examples are also possible.

It should be noted that, in an underwater setting as discussed herein, the vertical orientation of the recovery system 100 shown in FIG. 1 may be reversed. For example, the first end 104 of the elongate recovery container 102 may face downward, rather than upward. In this configuration, rather than including the buoyant portion 106, the recovery cable 103 may be paid out by a weighted portion instead, which may or may not be integrated with the stop 105. Further, the UUV 101, after releasably securing the capture clip 112 to the recovery cable 103, may adjust the buoyancy of its ballast tanks 114, 115 in the opposite direction of that noted above, such that the UUV 101 is pointed "nose up" in a vertical orientation. The UUV 101 may then be drawn, via the recovery cable 103, upward into the elongate recovery container 102.

Further, the elongate recovery container 102 may be mounted in various different locations. For example, the elongate recovery container 102 may be mounted to the ocean floor, or to an underwater platform that is constructed for launching and receiving underwater vehicles. In some implementations, the elongate recovery container 102 may be integrated within a larger vessel, such as a manned submarine. For instance, a submarine may container one or more elongate recovery containers 102 for launching and retrieving smaller UUV's, such as the UUV 101. Similarly, one or more downward-facing elongate recovery tubes 102 might be integrated into the underside of a surface ship. In the case where the elongate recovery container 102 is part of a manned submarine or surface vessel, the elongate recovery container 102 may include a hatch or other opening for personnel to access the UUV 101 when stowed. Other examples are also possible.

Figure 2:
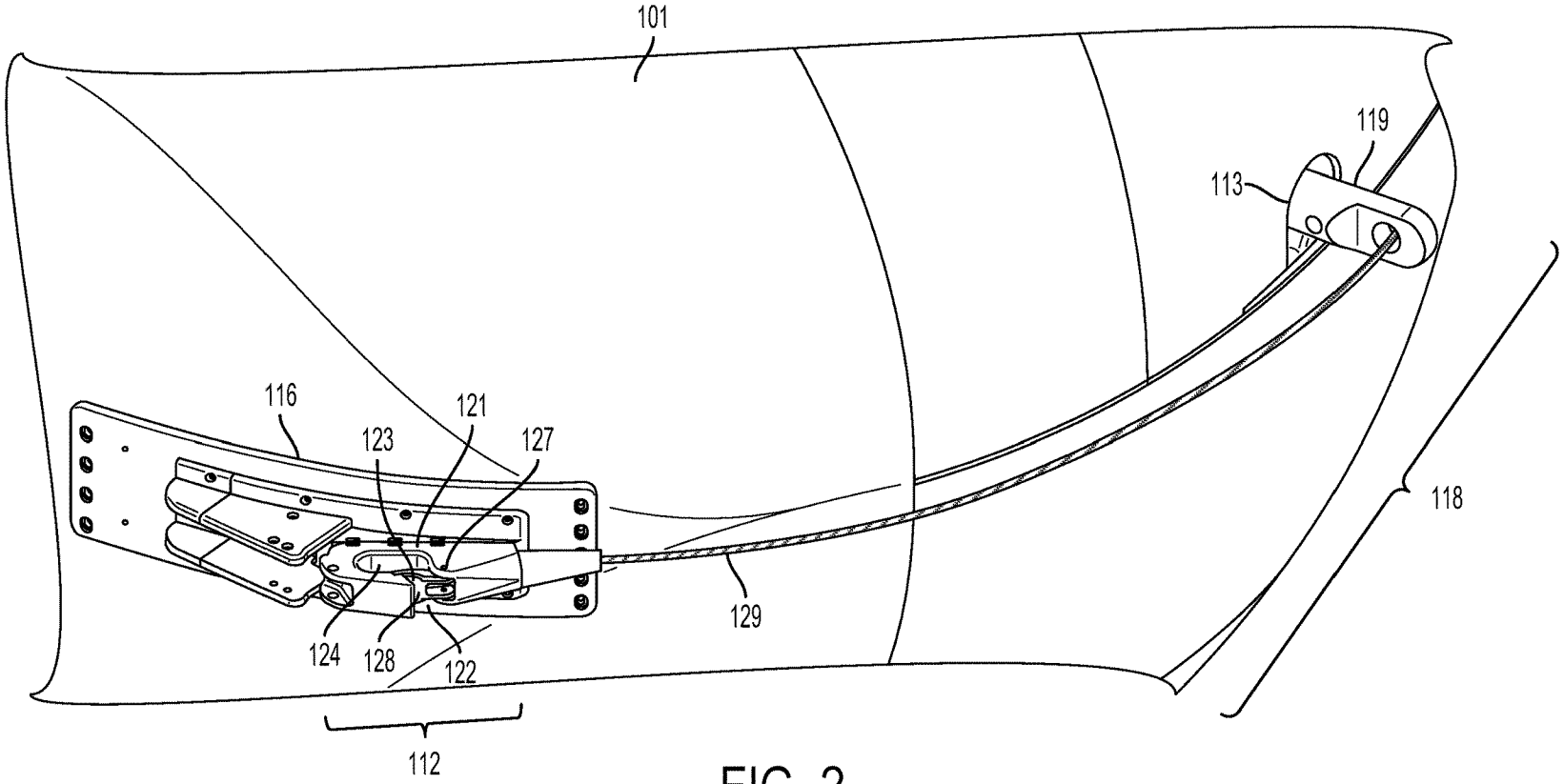
FIG. 2 illustrates a perspective view of an example capture clip of a UUV, according to an example implementation.
Figure 3:
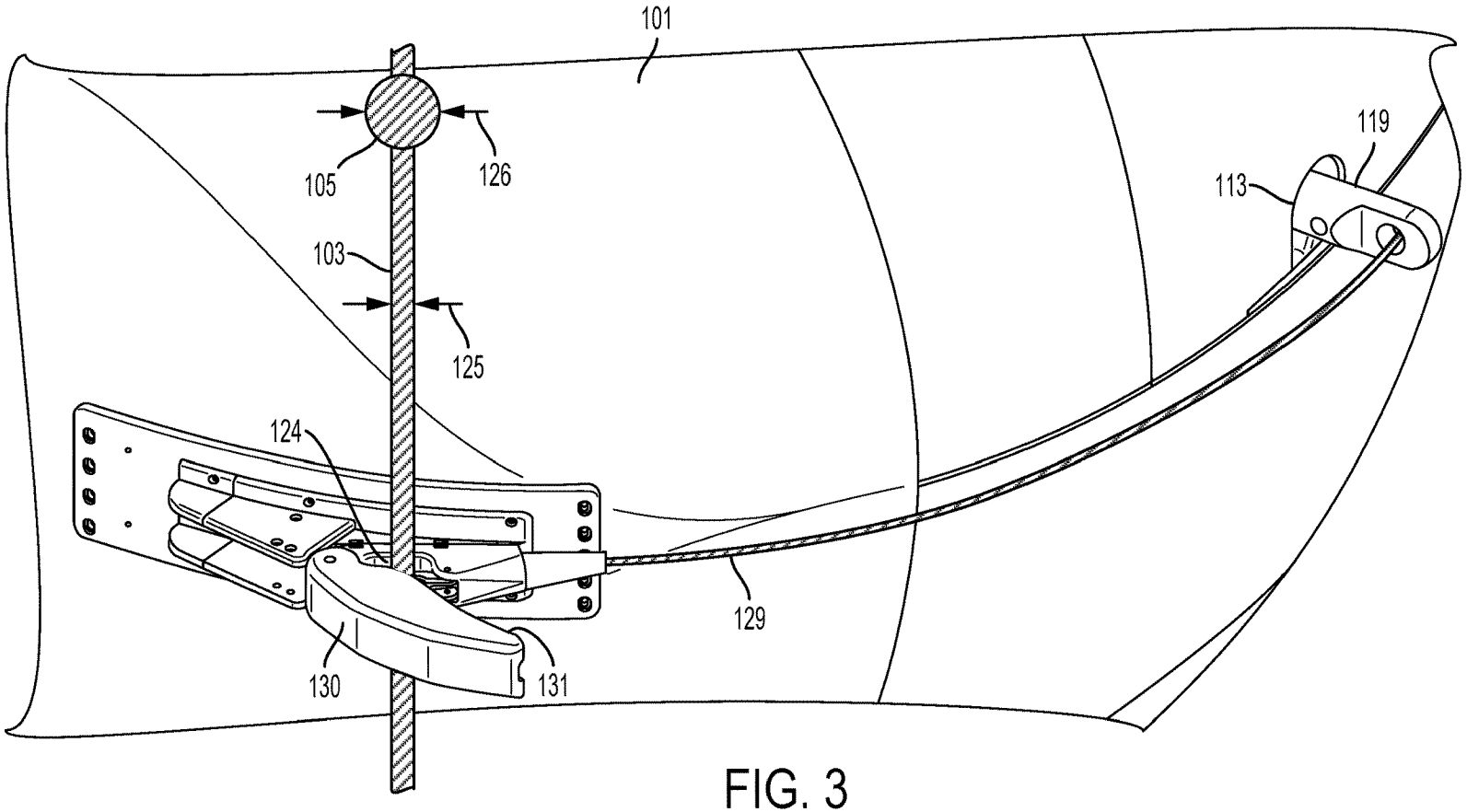
FIG. 3 illustrates another perspective view of an example capture clip of a UUV, according to an example implementation.

Moving now to FIGS. 2 and 3, a close-up view showing the nose portion 113 of the UUV 101 is illustrated, depicting an example implementation of the capture clip 112. In this example, the capture clip 112 includes a loop 121 that is releasably coupled to a side 116 of the UUV 101. A lead cable 129 further couples the loop 121 to the nose portion 113 of the UUV 101. For example, the nose portion 113 of the UUV 101 may include a bracket 119 or a similar structure, and the lead cable 129 may be coupled to the nose portion 113 via the bracket 119.

The loop 121 surrounds an opening 124, and further includes a gap 122 that is closed by a gate 123. This configuration may allow the recovery cable 103 to pass through the gap 122 and into the opening 124. For example, the UUV 101 may, after locating the recovery cable 103, guide itself toward the recovery cable 103 such that the convex forward face 118 makes contact with the recovery cable 103. As the UUV 101 continues to move forward, the recovery cable 103 may slide around the convex forward face 118 and along the side 116 of the UUV 101, toward the loop 121. Another loop, similar to the loop 121, may be located on the opposite side of the UUV 101, and similarly coupled to the nose portion 113 via a similar lead cable. In this way, the recovery cable 103 may be guided toward one of two capture clips 112 located on either side of the UUV 101, if the UUV 101 makes forward-moving contact with the recovery cable 103 anywhere on the convex forward face 118. This may provide the FLS system 111 with a margin of error when locating the recovery cable 103 and guiding the UUV 101 toward it.

As the UUV 101 continues to move forward and the recovery cable 103 reaches the loop 121, the recovery cable 103 may pass through the gap 122 and into the opening 124. In some implementations, the gate 123 may include a spring, such as the hinge spring 127 located at the connection of the gate 123 to the loop 121. Accordingly, the gate 123 may be openable by a movement of the UUV 101 against the recovery cable 103 to apply a force to the gate 123 from an outside 128 of the loop 121, thereby compressing the spring 127. Once the recovery cable 103 opens the gate 123 and passes into the opening, the spring 127 may restore the gate 123 to its original position, closing the gap 122 and maintaining the recovery cable 103 within the opening 124, releasably securing the loop 121 to the recovery cable 103. In this way, the loop 121 may resemble a carabiner.

FIG. 3 shows the recovery cable 103 within the opening 124 of the loop 121. The opening 124 is larger than a diameter 125 of the recovery cable 103 and smaller than a diameter 126 of the stop 105. This may allow the recovery cable 103 to be retracted downward and pulled through the loop 121 until the stop 105 reaches the loop 121. Because the stop 105 will not pass through the opening, further retracting the recovery cable 103 will begin to retract the UUV 101 as well. Further, after the recovery cable 103 is releasably secured within the opening 124, the loop 121 may detach from the side 116 of the UUV 101, while remaining coupled to the nose portion 113 of the UUV 101 via the lead cable 129. This may allow the UUV 101 to be pulled downward from the nose portion 113.

As discussed in the example above, the capture clip 112 may act passively, becoming releasably secured to the recovery cable 103 as a result of the movement of the UUV 101 into the recovery cable 103. In other implementations, the capture clip 112 may be actuated more actively. For instance, the gate 123 shown in FIG. 2 might be initially fixed in an open position. When the recovery cable 103 moves through the gap 122 and into the opening 124, one or more sensors, such as a force sensor within the loop 121, may detect the recovery cable 103, causing a solenoid or other actuator to move the gate 123 to a closed position. Other examples are also possible.

Returning to the example shown in FIG. 3, the capture clip 112 may further include a guide finger 130 in some implementations that is positioned adjacent to the loop 121. The guide finger 130 may be extendable from the side 116 of the UUV 101 and shaped such that the recovery cable 103 is biased toward the gap 122 when in contact with a forward edge 131 of the guide finger 130, when the guide finger 130 is extended. For instance, as shown in FIG. 3, the guide finger 130 may extend outwardly from the side 116 of the UUV 101 so that the forward edge 131 forms a "V" shape with the side 116 of the UUV 101. This may prevent the recovery cable 103 from jumping or otherwise passing over the gap 122 as the UUV 101 moves past the recovery cable 103. Instead, the recovery cable 103 may contact the forward edge 131 of the guide finger 130, which may then bias the recovery cable 103 toward the bottom of the "V" and into the gap 122.

Figure 4:
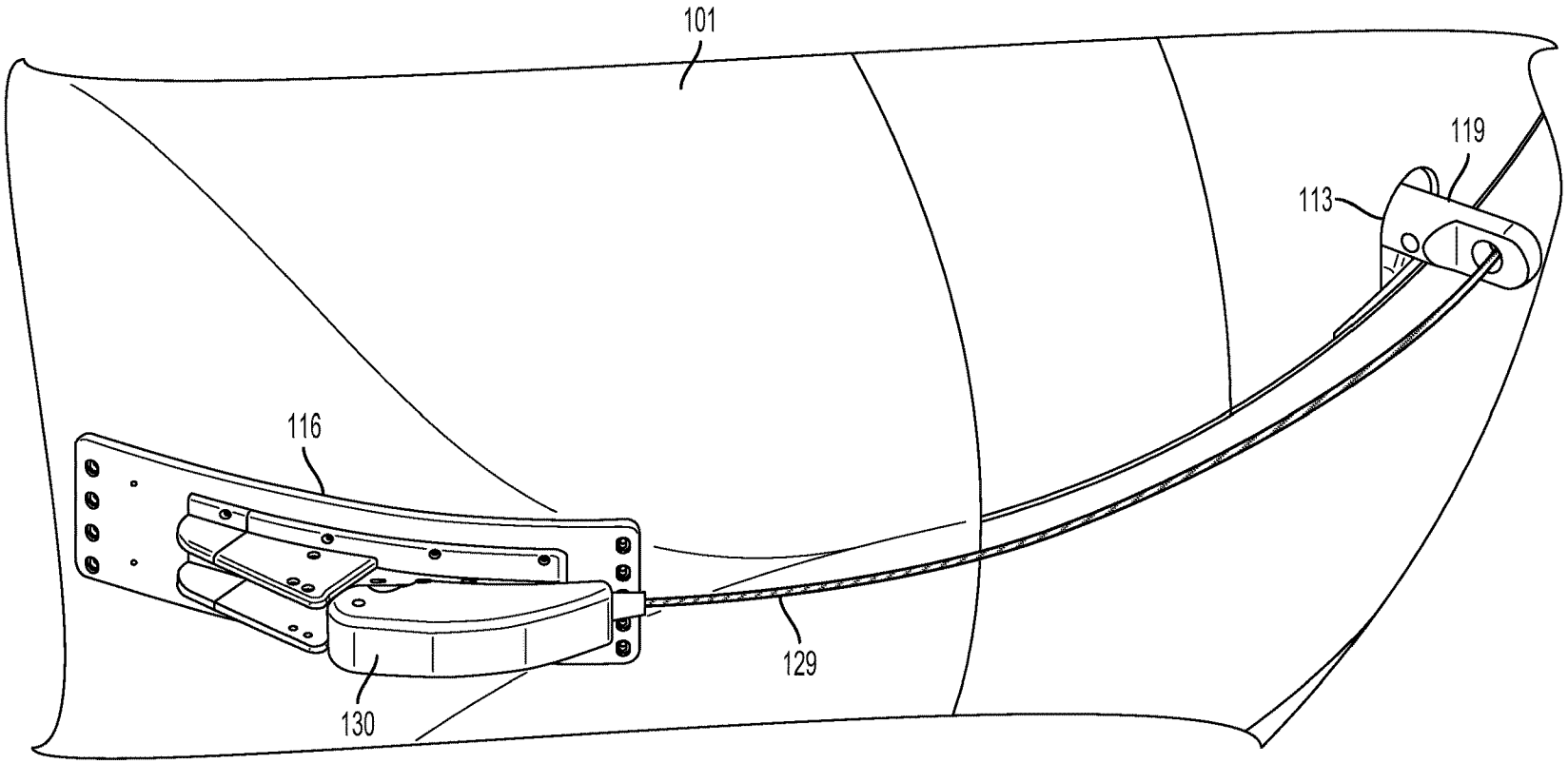
FIG. 4 illustrates another perspective view of an example capture clip of a UUV, according to an example implementation.

FIG. 4 shows the UUV 101 with the guide finger 130 in a non-extended position. For example, the non-extended guide finger 130 may lie over the gap 122 of the loop 121, and may prevent miscellaneous objects from being caught in the loop 121 before the UUV 101 begins a recovery operation. In some implementations, the guide finger 130 may be extended after the UUV 101 detects the recovery cable 103 using the FLS system 111.

The capture clip 112 may take other configurations than that shown in FIG. 2-4, and in other locations on the UUV 101. In some examples, the capture clip 112 may be coupled directly to the nose portion 113 of the UUV 101, and therefore the lead cable 129 might not be needed. For example, a loop similar to the loop 121 may be coupled directly to the nose portion 113, and a set of guide fingers may extend outward from the nose portion 113 on either side of the loop to bias the recovery cable 103 into the capture clip 112. While this configuration may not require the lead cable(s) 129 and the releasable loop(s) 121 on one or both side(s) 116 of the UUV 101, there may be a smaller margin for error in navigating the UUV 101 to make contact with the recovery cable 103 more precisely on the nose portion 113. Thus, a relatively higher resolution may be required of the FLS system 111.

Further, the capture clip 112 itself may take other forms as well. The example, the capture clip 112 may include a hook that extends from the UUV 101, and then is retracted once the recovery cable 103 is within the hook, thereby releasably securing the recovery cable 103 to the UUV 101. The capture clip 112 may alternatively resemble pair of jaws or a claw that snaps closed once contact is made with the recovery cable 103. Other examples are also possible. Again, the capture clip 112 in each of these implementations may act passively, through the use of springs and the like, or it may be actuated based on certain detected conditions. In some implementations, the recovery cable 103 may be magnetized, or contain a magnetized portion, which may aid in identification of the recovery cable 103 by the UUV 101, aid in its capture by the capture clip 112, or a combination of both. Numerous other possibilities also exist.

Figure 5:
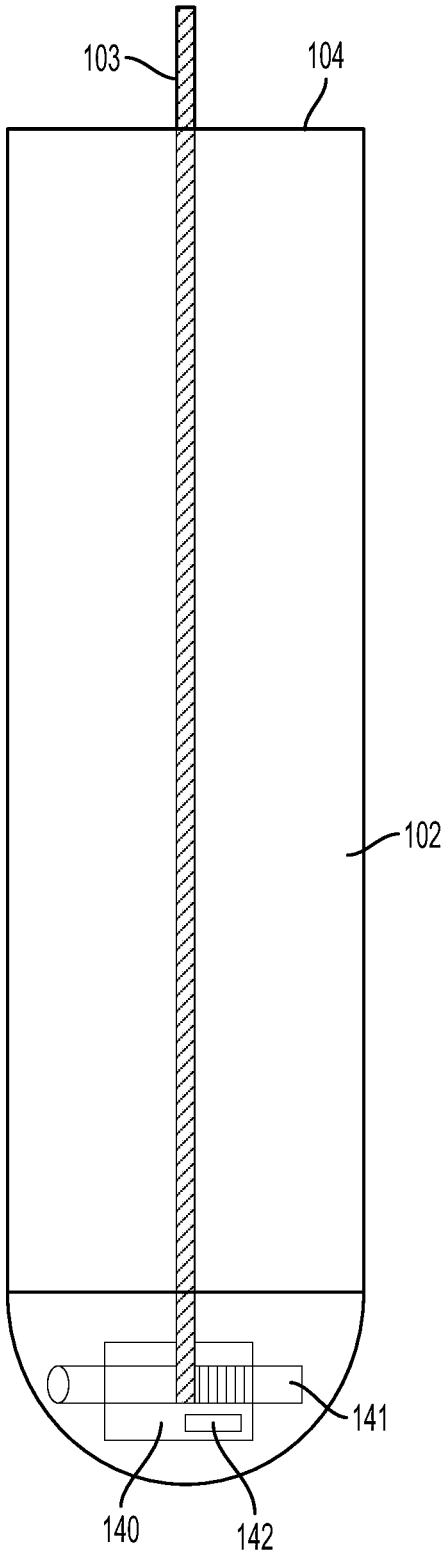
FIG. 5 illustrates an example elongate recovery container, according to an example implementation.

Turning to FIG. 5, the elongate recovery container 102 is shown, including a winch 140 positioned within the elongate recovery container 102. The recovery cable 103 is attached to the winch 140, and is retractable into the elongate recovery container 102 by winding the recovery cable 103 onto the winch 140. Similarly, the recovery cable 103 may be paid out by unwinding the winch 140, and allowing the buoyant portion 106 to draw the recovery cable 103 upwards, out of the first end 104 of the elongate recovery container 102.

The winch 140 may also include additional components that may provide information to the winch 140 for when begin winding or unwinding the recovery cable 103. For example, the winch 140 may include a force sensor 141, which may be configured to detect a tensile force on the recovery cable 103. In some implementations, the force sensor 141 may detect a tensile force on the recovery cable 103 that corresponds to the jolt of the UUV 101 being releasably secured to the recovery cable 103. In other examples, the UUV 101 adjusting its ballast tanks to reorient itself to a vertical orientation may create a tensile force on the recovery cable 103. After detecting a tensile force that is above a certain threshold force, via the force sensor 141, the winch 140 may begin retracting the recovery cable 103.

Similarly, the force sensor 141 may indicate when the UUV 101 has been full retracted into the elongate recovery container 102. For instance, the UUV may hit a stop within the elongate recovery container 102, and continuing to wind the recovery cable 103 may overdrive the winch 140. The force sensor 141 may detect the increased force, and send a signal for the winch 140 to stop winding. Other examples are also possible.

Additionally or alternatively, the elongate recovery container 102 may include a communications interface 142 for receiving and processing signals, such as electrical, acoustic, or radio signals, among others. For example, the elongate recovery container 102 may receive communications via an underwater transmission cable, or from the submarine or surface vessel that it may be mounted to. Further, the elongate recovery container 102 may receive communications directly from the UUV 101.

In some implementations, the UUV 101 may include an acoustic communications array 117, as shown in FIG. 1, which may be configured to transmit an indication to the elongate recovery container 102. For instance, the UUV 101 may transmit a signal via the acoustic communications array 117 that indicates the UUV 101 is a predetermined distance from the elongate recovery container 102. Based on this indication, received via the communications interface 142, the winch 140 may pay out the recovery cable 103. Similarly, the UUV 101 may be equipped with sensors to detect that the capture clip 112 has been releasably secured to the recovery cable 103. Once secured, the UUV 101 may transmit an indication via the acoustic communications array 117 that the UUV 101 is releasably secured to the recovery cable 103. Based on this indication, the winch 140 may retract the recovery cable 103. Other possibilities also exist.

FIGS. 6-11 show a sequence illustrating the recovery system 100 during operation, including recovery of the example UUV 101. The sequence begins at FIG. 6, which shows the UUV 101 approaching the recovery cable 103 at a first time of operation. The recovery cable 103 has already been paid out from the first end 104 of the elongate recovery container 102. In the example shown in FIG. 6, the stop 105 includes a buoyant portion which draws the recovery cable 103 upward out of the elongate recovery container 102, and thus there is not a separate buoyant portion 106 on the recovery cable, as shown in the example of FIG. 1.

Figure 7:
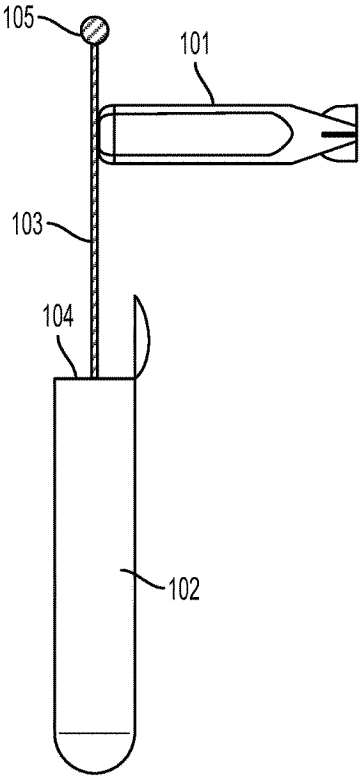
FIG. 7 illustrates the example recovery system in FIG. 6 at a second time of operation, according to an example implementation.
Figure 6:
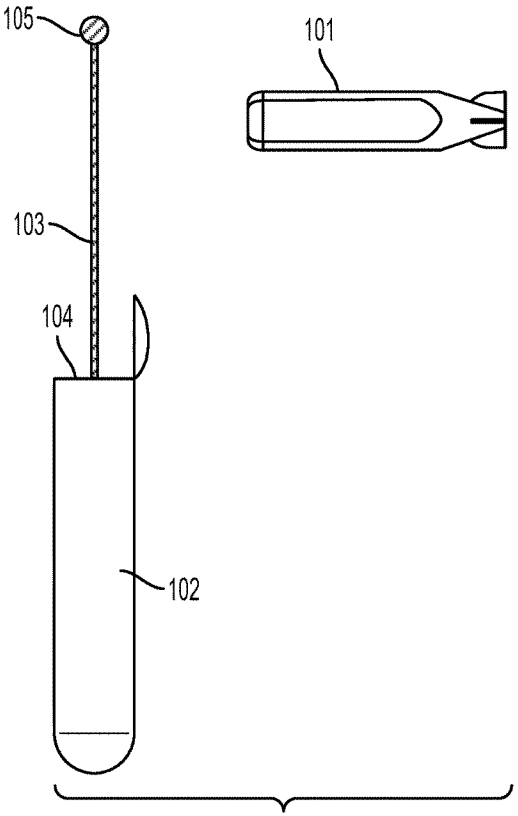
FIG. 6 illustrates an example recovery system for a UUV at a first time of operation, according to an example implementation.

In FIG. 7, the recovery system 100 is shown at a second time of operation, where the UUV 101 has guided itself toward the recovery cable 103 and made contact with the recovery cable 103 at the nose portion 113. In some implementations, as discussed above, the capture clip 112 may be positioned on the nose portion 113 of the UUV 101, and FIG. 7 may approximate the time where the UUV 101 becomes releasably secured to the recovery cable 103. In other examples, such as the one illustrated in FIGS. 2-4, the recovery cable 103 may slide around the convex forward face 118 of the UUV 101 as it continues to move forward. The recovery cable 103 may then engage a capture clip 112 that is located on the side 116 of the UUV 101, and further tethered to the nose portion 113 via a lead cable 129.

Figure 8:
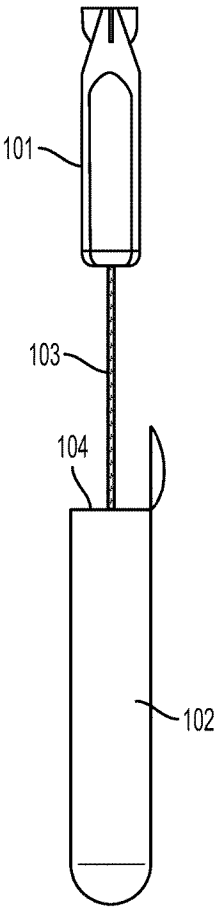
FIG. 8 illustrates the example recovery system in FIGS. 6 and 7 at a third time of operation, according to an example implementation.

FIG. 8 illustrates the recovery system 100 at a third time of operation, after the UUV 101 has reoriented itself into a "nose down" vertical orientation by adjusting the water level in its ballast tanks 114, 115. FIG. 8 shows an example in which the capture clip 112 has been releasably secured to the recovery cable 103 below the stop 105, and the UUV 101 has reoriented itself vertically while there is still excess recovery cable 103 above the capture clip 112. In other words, the stop 105 has not yet engaged the capture clip 112. In other examples, after the capture clip 112 is releasably secured to the recovery cable 103, the stop 105 may engage the capture clip 112 before the UUV 101 adjusts its ballast tanks.

In the example shown in FIGS. 2-4, the loop 121 is releasably coupled to the side 116 of the UUV 101, and will be released to enable the lead cable 129 to pull the UUV 101 downward from the nose portion 113. The loop 121 may be released from the side 116 of the UUV 101 either before or after the UUV 101 reorients itself in FIG. 8. For instance, the loop 121 may be released when the recovery cable 103 initially passes through the gap 122. Alternatively, the loop 121 may be released from the side of the UUV 101 only after the recovery cable 103 is drawn downward and the stop 105 engages the loop 121. As noted above, this may occur in some examples after the UUV 101 has vertically oriented itself. Other examples are also possible.

Figure 9:
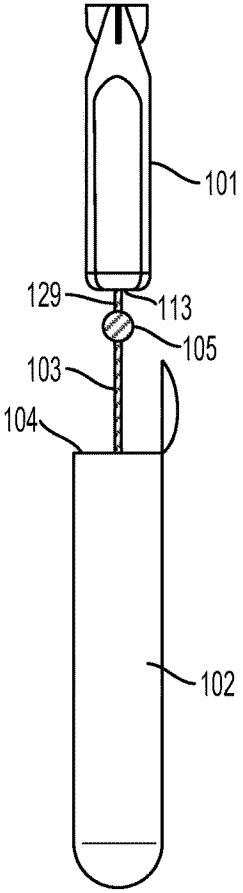
FIG. 9 illustrates the example recovery system in FIGS. 6-8 at a fourth time of operation, according to an example implementation.

In FIG. 9, the recovery system 100 is shown at a fourth time of operation, in which the elongate recovery container 102 has begun to retract the recovery cable 103, and with it, the UUV 101. Accordingly, any slack that was initially present in the recovery cable 103 shown in FIG. 8 has been drawn in, and the stop 105 can be seen at the end of the recovery cable 103. The lead cable 129 extends from the nose portion 113 of the UUV 101, where it is releasably secured to the recovery cable 103 via the capture clip 112.

Figure 11:
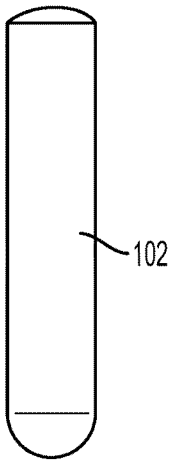
FIG. 11 illustrates the example recovery system in FIGS. 6-10 at a sixth time of operation, according to an example implementation.
Figure 10:
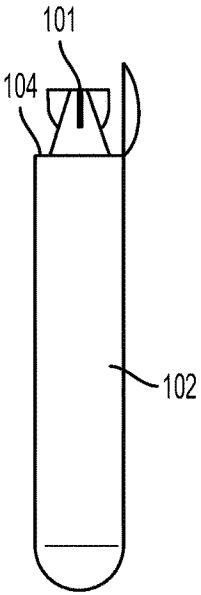
FIG. 10 illustrates the example recovery system in FIGS. 6-9 at a fifth time of operation, according to an example implementation.

FIG. 10 shows the recovery system 100 at a fifth time of operation, wherein the UUV 101 is being drawn downward into the elongate recovery container 102, and the recovery operation is nearly completed. In FIG. 11, showing the recovery system 100 at a sixth time of operation, the UUV 101 is stowed within the elongate recovery container 102, and the first end 104 of the elongate recovery container may be closed.

In addition, the sequence shown in FIGS. 6-11 may operate substantially in reverse to deploy the UUV 101 from the elongate recovery container 102. For instance, the winch 140 may pay out the recovery cable 103 and the UUV 101, which may be drawn out of the elongate recovery container 102 by the buoyancy of the UUV 101, which may be adjusted as necessary via the ballast tanks. Then the UUV 101 may level itself to a horizontal orientation by, for example, equalizing the water levels in its forward and aft ballast tanks 114, 115. Depending on the configuration of the capture clip 112, the capture clip 112 may then release the recovery cable 103, and the UUV 101 may navigate away from the elongate recovery container 102.

Alternatively, in some examples the capture clip 112 may need to be manually released from the recovery cable 103. This may be possible in implementations where the elongate recovery container 102 is mounted within a submarine or surface vessel, where the UUV 101 may be accessible when stowed within the elongate recovery container 102. For instance, the capture clip 112 may be released from the recovery cable 103, and perhaps reset to its original position on the side 116 of the UUV 101. While stowed, the UUV 101 may then be reattached to the recovery cable 103 via a deployment clip, which may be easily disengaged or detached from the UUV 101 when it is next deployed. Other possibilities also exist.

Further, in addition to stowing the UUV 101 between recovery and deployment, the elongate recovery container 102 may interface with the UUV 101 as well. For example, the elongate recovery container 102 may contain a port or terminal on its interior that interfaces with the UUV 101 when stowed. The terminal may be used to, for example, charge a battery of the UUV 101, or transfer data to the UUV 101, such as operational or navigational data. Other examples are also possible.

Figure 12:
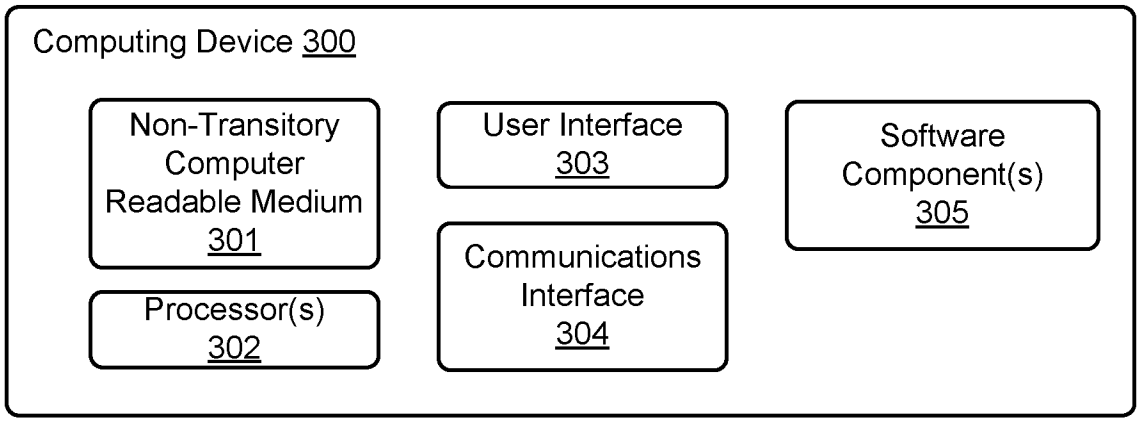
FIG. 12 illustrates a block diagram of an example computing device, according to an example implementation.

FIG. 12 illustrates a block diagram of an example computing device 300 that may be used to implement some or all of the operations discussed herein. For instance, the computing device 300 may be an onboard computer on the UUV 101, or it may be a remote computer that is communicatively coupled to the UUV 101 via a communications link. Further, the computing device 300 shown in FIG. 12 might not be embodied by a single device, but may represent a combination of computing devices that may or may not be in the same location.

The computing device 300 may include a non-transitory, computer readable medium 301 that includes instructions that are executable by one or more processors 302. The non-transitory, computer readable medium 301 may include other data storage as well, such as navigation data. For example, the UUV 101 may store navigation data in the non-transitory, computer-readable medium 301 corresponding to a location of the elongate recovery container 102.

In some implementations, the computing device 300 may include a user interface 303 for receiving inputs from a user, and/or for outputting operational data to a user. The user interface 303 might take the form of a control panel located on the UUV 101, a control panel on the elongate recovery container 102, or a graphical user interface at a remote location, connected to the UUV 101 and the elongate recovery container 102 via a communications interface 304, among other examples. For instance, a command for the UUV 101 to navigate to the elongate recovery container 102 and locate the recovery cable 103 may be received from a remote user via the user interface 303. The command may be received by the UUV 101 via a communications interface 304. In other examples, operations of the UUV 101 might be initiated automatically, based on pre-determined parameters stored on the non-transitory, computer readable medium 301. Other possibilities also exist.

In addition, the non-transitory, computer readable medium 301 may be loaded with one or more software components 305 stored on the computer readable medium 301 and executable by the processor 302 to achieve certain functions. For example, the UUV 101 may include various systems that contribute to its operation, such as a navigation system, the FLS system 111, and a propulsion system, among other examples. Each of these systems may be operated in part by software components 305 housed on the non-transitory, computer readable medium 301 and executable by the processor 302.

Figure 13:
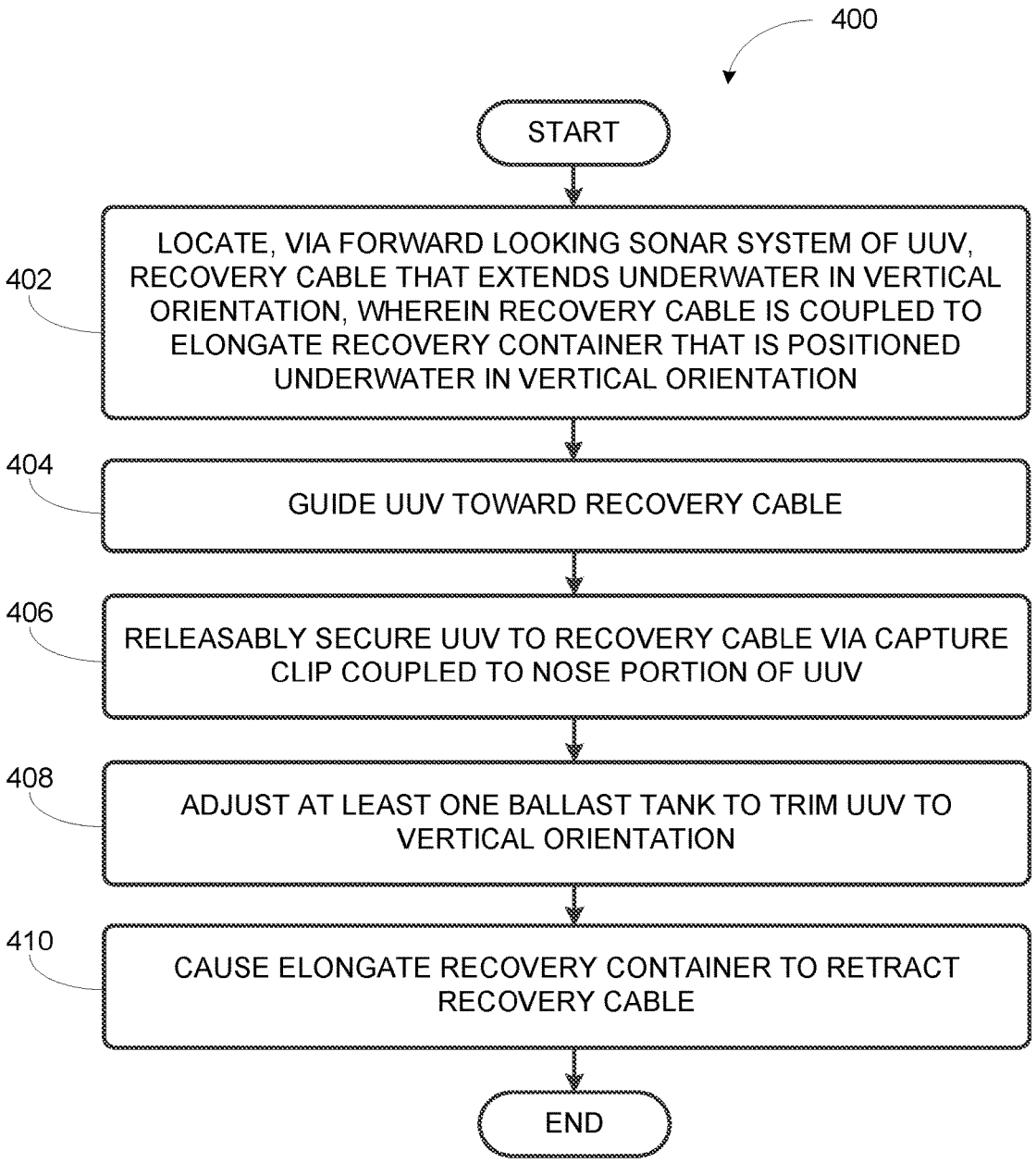
FIG. 13 shows a flowchart of an example method for recovery of a UUV.

FIG. 13 shows a flowchart of an example method 400 for recovery of an unmanned underwater vehicle. Method 400 shown in FIG. 12 presents an embodiment of a method that, for example, could be used with the recovery system 100 as shown in FIGS. 1-12 and discussed herein. It should be understood that for this and other processes and methods disclosed herein, flowcharts show functionality and operation of one possible implementation of present embodiments. In this regard, each block in the flowchart may represent a module, a segment, or a portion of program code, which includes one or more instructions executable by a processor, such as the processor 302 of the computing device 300, for implementing or causing specific logical functions or steps in the process. Alternative implementations are included within the scope of the example embodiments of the present disclosure, in which functions may be executed out of order from that shown or discussed, including substantially concurrently, depending on the functionality involved, as would be understood by those reasonably skilled in the art.

At block 402, the method 400 includes locating, via the FLS system 111 of the UUV 101, the recovery cable 103 that extends underwater in a vertical orientation. As shown in FIG. 1, the recovery cable 103 is coupled to the elongate recovery container 102 that is positioned underwater in a vertical orientation. For example, the elongate recovery container 102 may include an upward-facing first end 104. Accordingly, the method 400 may further include opening the upward-facing first end 104 of the elongate recovery container 102 and paying out the recovery cable 103. The recovery cable 103 may include the buoyant portion 106 that is configured to draw the recovery cable 103 upward out of the elongate recovery container 102. Further, causing the elongate recovery container 102 to retract the recovery cable 103, discuss at block 410 below, may include pulling the UUV 101 downward, via the recovery cable 103, through the upward-facing first end 104 of the elongate recovery container 102.

As noted above, the upward orientation of the elongate recovery container 102 and corresponding downward recovery of the UUV 101 may be reversed, such that the first end 104 of the elongate recovery container faces downward, and the UUV 101 is retracted into the elongate recovery container 102 in an upward direction.

At block 404, the method 400 includes guiding the UUV 101 toward the recovery cable 103. For example, the UUV 101 may include navigation and propulsion systems, which may include coordinates for the location of the elongate recovery container 102. The UUV 101 may navigate to the coordinates, which may approximate the location of the recovery cable 103. The UUV 101 may then utilize its FLS system 111 to locate the recovery cable 103, and its propulsion system to guide itself toward the recovery cable 103.

At block 406, the method 400 includes releasably securing the UUV 101 to the recovery cable 103 via a capture clip 112 coupled to a nose portion 113 of the UUV 101. As discussed above, the capture clip 112 may take a number of different forms. In the example shown in FIGS. 2-4, the capture clip 112 includes the loop 121 that is releasably coupled to the side 116 of the UUV 101. The loop 121 includes the gap 122 that is closed by the gate 123. Further, the loop 121 surrounds the opening 124 that is larger than the diameter 125 of the recovery cable 103 and smaller than the diameter 126 of the stop 105. The lead cable 129 couples the loop 121 to the nose portion 113 of the UUV 101.

After guiding the UUV 101 toward the recovery cable 103 at block 406, the method 400 may include causing the convex forward face 118 of the UUV 101 to make contact with the recovery cable 103, below the stop 105, such that the recovery cable 103 is displaced and drawn along the side 116 of the UUV 101. In this example, as shown in FIGS. 2-3, releasably securing the UUV 101 to the recovery cable 103 may include passing the recovery cable 103 through the gap 122 of the loop 121 and into the opening 124. Thereafter, the method 400 may include releasing the loop 121 from the side 116 of the UUV 101 such that the UUV 101 is releasably secured to the recovery cable 103 via the lead cable 129.

As noted above, the gate 123 may include a spring 127, and passing the recovery cable 103 through the gap 122 of the loop 121 may include opening the gate 123 via a force applied by the recovery cable 103 to the gate 123 from the outside 128 of the loop 121, thereby compressing the spring 127. In some implementations, as shown in FIGS. 3-4 the capture clip 112 may include the guide finger 130 positioned adjacent to the loop 121. Before passing the recovery cable 103 through the gap 122 of the loop 121, the method 400 may further include extending the guide finger 130 from the side 116 of the UUV 101. The guide finger 130 is shaped such that the recovery cable 103 is biased toward the gap 122 when in contact with a forward edge 131 of the guide finger 130.

At block 408, the method 400 includes adjusting at least one ballast tank 114 to trim the UUV 101 to a vertical orientation. For example, the UUV 101 may include a forward ballast tank 114 and an aft ballast tank 115, and may move water from the aft ballast tank 115 to the forward ballast tank 114 to adjust its trim orientation to a "nose down" position. Alternatively, in an example where the vertical orientation is reversed, the UUV 101 may move water from the forward ballast tank 114 to the aft ballast tank 115, to trim itself to a "nose up" orientation.

At block 410, the method 400 includes causing the elongate recovery container 102 to retract the recovery cable 103. As discussed above and as shown in FIG. 5, causing the elongate recovery container 102 to retract the recovery cable 103 may include winding the recovery cable 103 onto the winch 140 that is positioned within the elongate recovery container 102.

The winch 140 may begin retracting the recovery cable 103 based on a number of different cues. As one example, the winch 140 may detect, via the force sensor 141, a tensile force on the recovery cable 103 that is above a threshold tensile force, which may correspond to the UUV 101 being releasably secured to the recovery cable 103. Accordingly, causing the elongate recovery container 102 to retract the recovery cable 103 may be based on the detected tensile force.

As another example, the retraction of the recovery cable 103 may be time-based. For instance, the method 400 may include the elongate recovery container 102 receiving, from the UUV 101, an indication that the UUV 101 is a predetermined distance from the elongate recovery container 102. The predetermined distance may be, for example, fifty meters. In some implementations, the UUV 101 may transmit the indication via the acoustic communications array 117. Thereafter, based on the received indication, the method 400 may include causing the elongate recovery container 102 to retract the recovery cable 103 after a predetermined length of time has elapsed from receiving the indication. The predetermined length of time may be, for example, five minutes, and may correspond to a time period after which the UUV 101, navigating toward the recovery cable 103 and starting from the predetermined distance, is likely to be releasably secured to the recovery cable 103. Although the time-based retraction of the recovery cable 103 is not based on an affirmative indication that the UUV 101 is releasably secured to the recovery cable 103, it may reduce the need for additional sensors associated with the capture clip 112.

Alternatively, the method 400 may include the elongate recovery container 102 receiving, from the UUV 101, an indication that the UUV 101 is releasably secured to the recovery cable 103, as discussed above.

The description of the different advantageous arrangements has been presented for purposes of illustration and description, and is not intended to be exhaustive or limited to the embodiments in the form disclosed. Many modifications and variations will be apparent to those of ordinary skill in the art. Further, different advantageous embodiments may describe different advantages as compared to other advantageous embodiments. The embodiment or embodiments selected are chosen and described in order to explain the principles of the embodiments, the practical application, and to enable others of ordinary skill in the art to understand the disclosure for various embodiments with various modifications as are suited to the particular use contemplated.

What is claimed is:

1. A recovery system for an unmanned underwater vehicle (UUV), comprising:

an elongate recovery container sized to contain the UUV;

a recovery cable coupled to the elongate recovery container, wherein the recovery cable is retractable into the elongate recovery container to capture and stow the UUV within the elongate recovery container; and the UUV, comprising:

a forward looking sonar system configured to locate the recovery cable;

a capture clip coupled to a nose portion of the UUV, wherein the capture clip is configured to be releasably secured to the recovery cable; and at least one ballast tank capable of trimming the UUV to a vertical orientation.

2. The system of claim 1, wherein the elongate recovery container comprises a first end that is openable to pay out the recovery cable, and wherein the recovery cable is retractable into the elongate recovery container via the first end.

3. The system of claim 1, wherein the at least one ballast tank comprises a forward ballast tank fluidly coupled to an aft ballast tank.

4. The system of claim 1 further comprising a stop positioned on the recovery cable, wherein the capture clip comprises:

a loop releasably coupled to a side of the UUV, wherein the loop comprises a gap that is closed by a gate, and wherein the loop surrounds an opening that is larger than a diameter of the recovery cable and smaller than a diameter of the stop; and a lead cable coupling the loop to the nose portion of the UUV.

5. The system of claim 4, wherein the gate comprises a spring, and wherein the gate is openable by a movement of the UUV against the recovery cable to apply a force to the gate from an outside of the loop, thereby compressing the spring.

6. They system of claim 4, wherein the capture clip further comprises a guide finger positioned adjacent to the loop, wherein the guide finger is extendable from the side of the UUV and shaped such that the recovery cable is biased toward the gap when in contact with a forward edge of the guide finger when the guide finger is extended.

7. The system of claim 1, wherein the elongate recovery container comprises a winch positioned within the elongate recovery container, and wherein the recovery cable is retractable into the elongate recovery container by winding the recovery cable onto the winch.

8. The system of claim 7, wherein the winch comprises a force sensor configured to detect a tensile force on the recovery cable.

9. The system of claim 1, wherein the UUV further comprises an acoustic communications array configured to transmit an indication to the elongate recovery container.

10. A method for recovery of an unmanned underwater vehicle (UUV), comprising:

locating, via a forward looking sonar system of the UUV, a recovery cable that extends underwater in a vertical orientation, wherein the recovery cable is coupled to an elongate recovery container that is positioned underwater in a vertical orientation;

guiding the UUV toward the recovery cable;

releasably securing the UUV to the recovery cable via a capture clip coupled to a nose portion of the UUV;

adjusting at least one ballast tank to trim the UUV to a vertical orientation; and causing the elongate recovery container to retract the recovery cable.

11. The method of claim 10, wherein the elongate recovery container comprises an upward-facing first end, and wherein the method further comprises:

opening the upward-facing first end of the elongate recovery container;

paying out the recovery cable, wherein the recovery cable comprises a buoyant portion configured to draw the recovery cable upward out of the elongate recovery container; and wherein causing the elongate recovery container to retract the recovery cable comprises pulling the UUV downward, via the recovery cable, through the upward-facing first end of the elongate recovery container.

12. The method of claim 10, wherein adjusting the at least one ballast tank comprises moving water from an aft ballast tank to a forward ballast tank.

13. The method of claim 10, wherein a stop is positioned on the recovery cable, wherein the UUV comprises a convex forward face, and wherein the method further comprises:

after guiding the UUV toward the recovery cable, causing the convex forward face of the UUV to make contact with the recovery cable, below the stop, such that the recovery cable is displaced and drawn along a side of the UUV, wherein the capture clip comprises:

a loop releasably coupled to the side of the UUV, wherein the loop comprises a gap that is closed by a gate, and wherein the loop surrounds an opening that is larger than a diameter of the recovery cable and smaller than a diameter of the stop; and a lead cable coupling the loop to the nose portion of the UUV;

wherein releasably securing the UUV to the recovery cable comprises passing the recovery cable through the gap of the loop and into the opening; and releasing the loop from the side of the UUV such that the UUV is releasably secured to the recovery cable via the lead cable.

14. The method of claim 13, wherein the gate comprises a spring, and wherein passing the recovery cable through the gap of the loop comprises opening the gate via a force applied by the recovery cable to the gate from an outside of the loop, thereby compressing the spring.

15. The method of claim 13, wherein the capture clip further comprises a guide finger positioned adjacent to the loop, and wherein the method further comprises:

before passing the recovery cable through the gap of the loop, extending the guide finger from the side of the UUV, wherein the guide finger is shaped such that the recovery cable is biased toward the gap when in contact with a forward edge of the guide finger.

16. The method of claim 10, wherein causing the elongate recovery container to retract the recovery cable comprises winding the recovery cable onto a winch positioned within the elongate recovery container.

17. The method of claim 16, wherein the winch comprises a force sensor, and wherein the method further comprises:

detecting, via the force sensor, a tensile force on the recovery cable that is above a threshold tensile force, wherein causing the elongate recovery container to retract the recovery cable is based on the detected tensile force.

18. The method of claim 10, wherein causing the elongate recovery container to retract the recovery cable comprises:

receiving, from the UUV, an indication that the UUV is a predetermined distance from the elongate recovery container; and based on the received indication, causing the elongate recovery container to retract the recovery cable after a predetermined length of time has elapsed from receiving the indication.

19. The method of claim 10, wherein causing the elongate recovery container to retract the recovery cable comprises:

receiving, from the UUV, an indication that the UUV is releasably secured to the recovery cable.

20. A non-transitory computer readable medium having stored thereon instructions that, when executed by a computing device, cause the computing device to perform functions comprising:

locating, via a forward looking sonar system of an unmanned underwater vehicle (UUV), a recovery cable that extends underwater in a vertical orientation, wherein the recovery cable is coupled to an elongate recovery container that is positioned underwater in a vertical orientation;

guiding the UUV toward the recovery cable;

releasably securing the UUV to the recovery cable via a capture clip coupled to a nose portion of the UUV;

adjusting at least one ballast tank to trim the UUV to a vertical orientation; and causing the elongate recovery container to retract the recovery cable.

* * * * *